US007884333B2

(12) United States Patent
Delayen

(10) Patent No.: US 7,884,333 B2
(45) Date of Patent: Feb. 8, 2011

(54) PARTICLE BEAM AND CRABBING AND DEFLECTING STRUCTURE

(75) Inventor: Jean Delayen, Yorktown, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 327 days.

(21) Appl. No.: 12/284,799

(22) Filed: Sep. 25, 2008

(65) Prior Publication Data

US 2010/0072388 A1 Mar. 25, 2010

(51) Int. Cl.

| | |
|---|---|
| ***H05H 7/00*** | (2006.01) |
| ***G21K 1/08*** | (2006.01) |
| ***H01J 3/26*** | (2006.01) |
| ***H01J 23/00*** | (2006.01) |

(52) U.S. Cl. ..... 250/396 R; 315/500; 315/5.41; 315/505; 315/506; 315/111.61

(58) Field of Classification Search ..... 250/396 R; 315/500, 505, 506, 5.41, 111.61
See application file for complete search history.

(56) References Cited

U.S. PATENT DOCUMENTS

| | | | | |
|---|---|---|---|---|
| 5,523,659 | A * | 6/1996 | Swenson | 315/506 |
| 7,098,615 | B2 * | 8/2006 | Swenson et al. | 315/505 |
| 7,276,708 | B2 * | 10/2007 | Barov | 250/396 R |

* cited by examiner

*Primary Examiner*—Nikita Wells

(57) ABSTRACT

A new type of structure for the deflection and crabbing of particle bunches in particle accelerators comprising a number of parallel transverse electromagnetic (TEM)-resonant) lines operating in opposite phase from each other. Such a structure is significantly more compact than conventional crabbing cavities operating the transverse magnetic TM mode, thus allowing low frequency designs.

7 Claims, 9 Drawing Sheets

PARTICLE BEAM AND CRABBING AND DEFLECTING STRUCTURE

The United States of America may have certain rights to this invention under Management and Operating Contract DE-AC05-060R23177 from the United States Department of Energy.

BACKGROUND OF THE INVENTION

Radio frequency (rf) cavities for the deflection or crabbing of particle beams have been developed for many years. Most of these devices are comprised of superconducting cavities operating in the transverse magnetic ($TM_{110}$) mode although some are room temperature structures operating in the $\lambda/4$ mode or are of the H-type. Crabbing rf structures have been of interest for the increase of luminosity in colliders and more recently for the generation of sub-picosecond X-ray pulses.

While all of these structural solutions have proven satisfactory and reliable, they have a number of major shortcomings. These include: 1) they are unsuited to low frequency applications; 2) they have large transverse dimensions; and 3) because of their requirement that they be located in the beam line they are not compact, but occupy significant beam line space.

Thus, there remains a need for a compact particle beam deflection/crabbing structure that is useful in low frequency applications and minimizes transverse dimensions.

OBJECTS OF THE INVENTION

It is therefore an object of the present invention to provide a compact particle beam deflection/crabbing structure.

It is another object of the present invention to provide a particle beam deflection/crabbing structure having a minimized transverse dimension.

It is yet a further object of the present invention to provide a particle beam deflecting/crabbing structure that is useful at low frequencies.

It is yet a further object of the present invention to provide a particle beam deflecting/crabbing structure that is efficient in using rf energy to create deflecting/crabbing voltages.

SUMMARY OF THE INVENTION

A new type of structure for the deflection and crabbing of particle bunches in particle accelerators comprising a number of parallel transverse electromagnetic (TEM)-resonant) lines operating in opposite phase from each other. Such a structure is significantly more compact than conventional crabbing cavities operating the transverse magnetic $TH_{110}$ mode, thus allowing low frequency designs.

DETAILED DESCRIPTION

As used in the description that follows, the following terms have the following meanings: "generally parallel" means that the elements are not necessarily completely parallel, but rather extend along side each other in the same directions and, in some cases, with mirror image shapes; $\lambda$ is the wavelength in the rf mode; R is the radius of rods 12, 14, and between the axes of rods 46, 48, etc.; A is one half of the distance between the axes of rods 12, 14, etc.; and Q is the quality factor of the structure.

Figure 1:
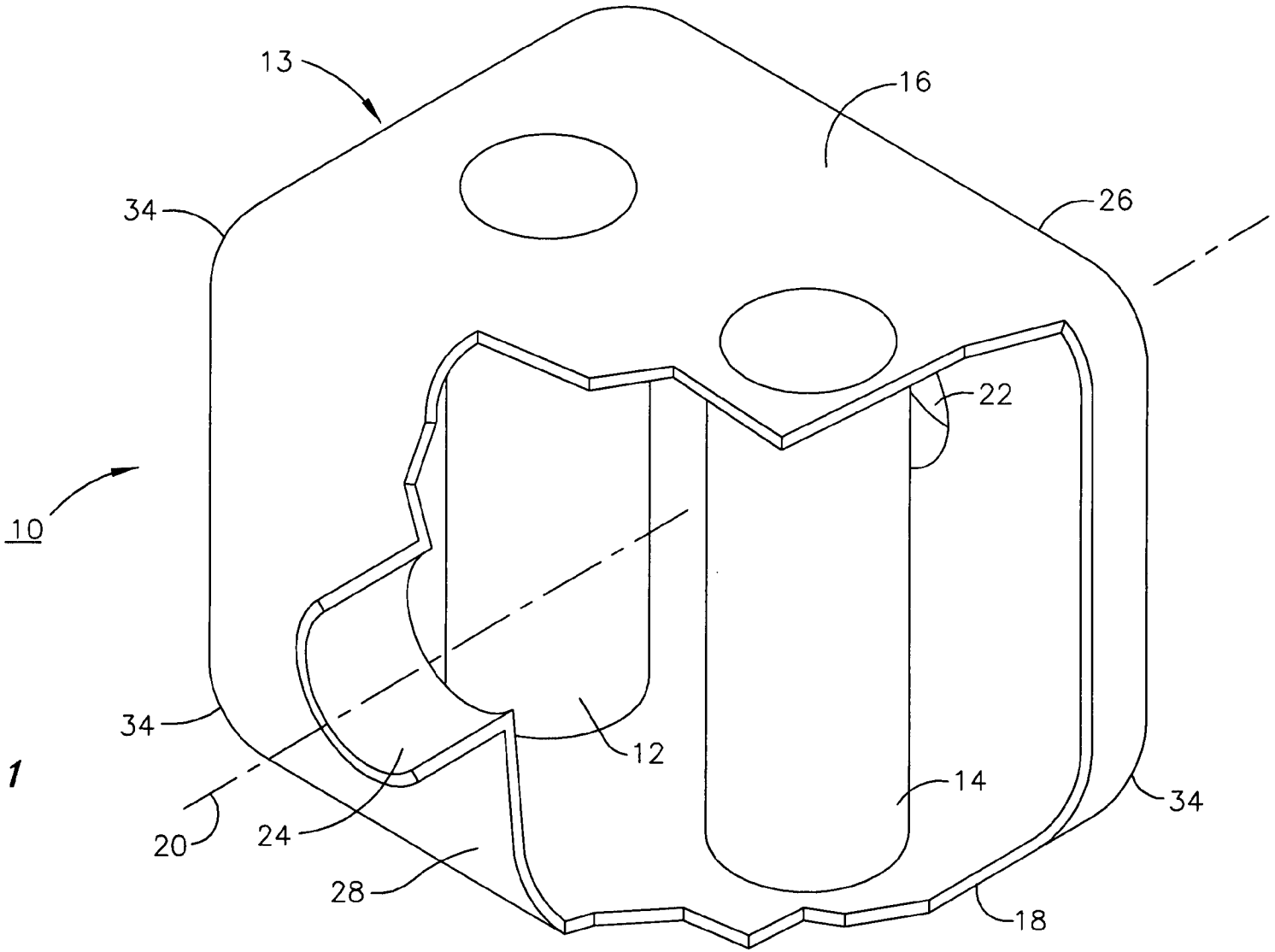
FIG. 1 is a perspective view of the parallel bar deflecting structure of the present invention.
Figure 2:
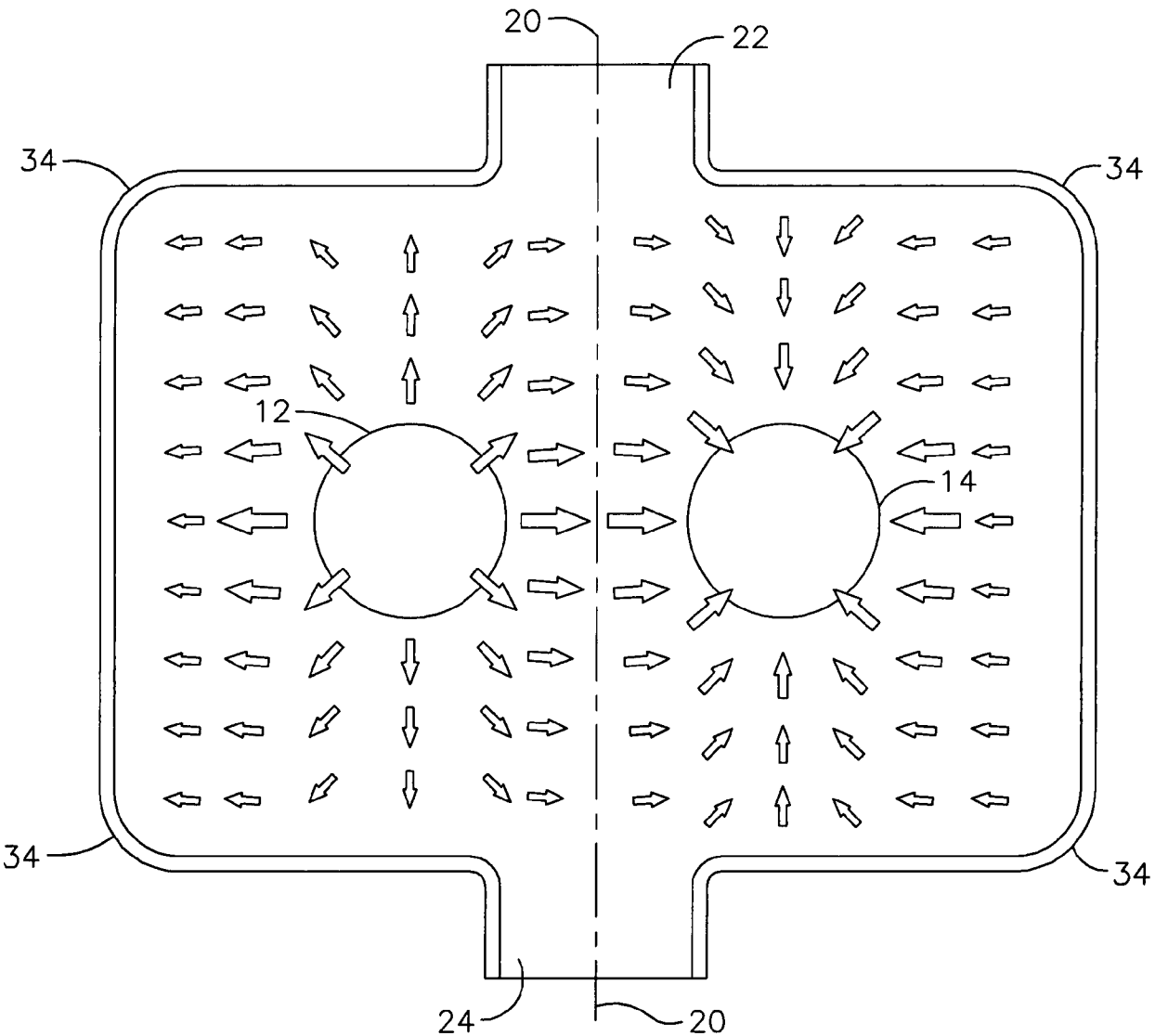
FIG. 2 is a top plan schematic view of the electric field in the mid-plane of the parallel-rod structure of FIG. 1 operating in the $\pi$-mode.
Figure 3:
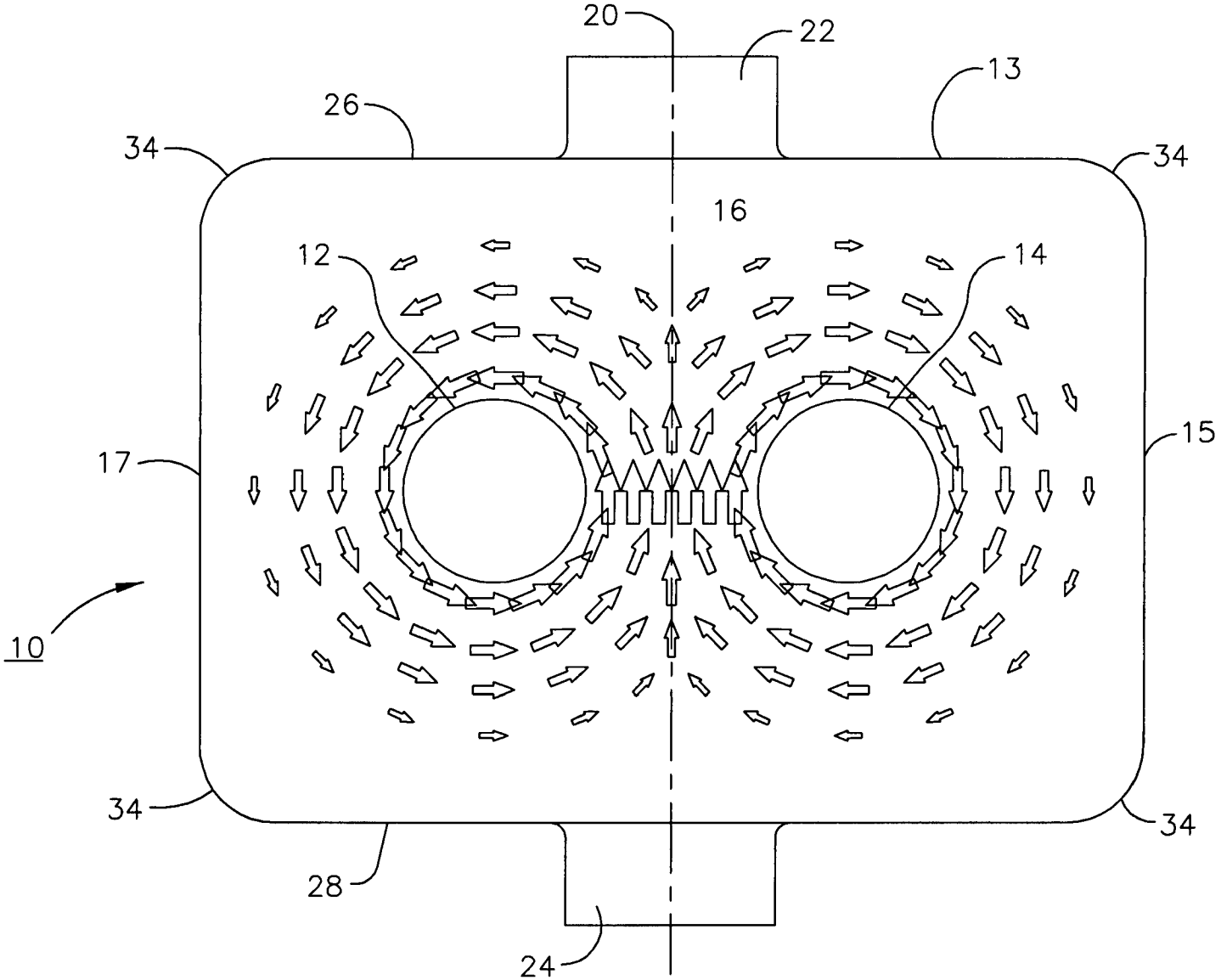
FIG. 3 is a top plan schematic representation of the electric field in the top plate of the parallel-rod structure of FIG. 1 operating in the $\pi$-mode.

Referring now to the accompanying drawings, as shown in FIG. 1, one embodiment of the deflecting/crabbing structure 10 of the present invention comprises at least one pair of opposing and generally parallel rods 12 and 14 of a length approximately $\lambda/2$ thus defining $\lambda/2$ TEM resonant lines operating in opposite phase. Rods 12 and 14 are susceptible to rf energy generating electromagnetic fields upon the application thereto of rf energy from an external source. The voltages generated are maximum and of opposite sign in the middle of rods 12 and 14 and generate a transverse electric field as shown in FIG. 2. The magnetic field is null in the mid-plane containing the beam line 20 and is maximum where rods 12 and 14 meet the shorting planes 16 and 18 (the top and bottom of housing 13 that also includes curved or rounded end walls 15 and 17 and rounded or curved side walls 26 and 28), as shown in FIGS. 1 and 3. Thus, unlike $TM_{110}$ structures where the deflection is produced by interaction with the magnetic field, in the parallel-rod structure 10 of the present invention, the deflection is produced by interaction with the electric field produced by the injection of rf energy. The length of rods 12 and 14 is dictated by the frequency at which the structure is to operate. That is a function of the particular application to which structure 10 is applied. The length of rods 12 and 14 is half the wavelength of the rf energy input. The spacing between rods 12 and 14 or between the rods of any rod pair, one on each side of the beam line 20, a free design parameter that depends on the application. The distance between the rod pair 12, 14 and the rod pair 46, 48 (and other subsequent pairs) is the distance that a particle in the beam travels along the beam line 20 in one half of an rf period; for a particle travelling at the speed of light it is one half of the wavelength. Beam pipe apertures 22 and 24 provide a path for the passage of beam line 20 through housing 13 between generally parallel rods 12 and 14.

The diameter/cross section/spacing of the bars are parameters that can be optimized by the designer depending on the requirements of the application. These parameters depend on whether the structure is room temperature or superconducting, or whether one wants to maximize the voltage or minimize the losses.

In the absence of beam pipe apertures 22 and 24, and if the outer side walls 15, 16, 17, 18, 26 and 28 were flat planes, as opposed to the rounded or curved shapes shown in the accompanying Figures, the deflecting $\pi$-mode would degenerate with the accelerating 0-mode where the rods 12 and 14 are oscillating in phase. Because the π-mode has no electric or magnetic field where beam line 20 meets side walls 26 and 28, while the 0-mode has an electric field, beam pipe apertures 22 and 24 remove the degeneracy. The mode splitting is further increased by rounding all the corners 34 as shown in FIG. 1 and in a more radical fashion in FIG. 9.

If the distance between side walls 15, 17, 26 and 28 and rods 12 and 14 is substantially larger than the distance between the rods and the vertical symmetry plane, then the walls' contributions to the electromagnetic properties will be small and the fundamental cell can be modeled by two parallel infinite planes separated by λ/2 and joined by two parallel cylinders of radius R and of axis-to-axis separation 2A. The properties of such a structure can be calculated exactly.

Defining the transverse electric field $E_t$ as $E_t=2V_t/\lambda$, where $V_t$ is the transverse voltage acquired by an on-crest, velocity-of-light particle, the peak surface electric field and transverse deflecting field is $$E_p/E_t=(1/4\pi)(\lambda/R)[(\alpha+1)/(\alpha-1)]^{1/2}\exp[2\pi R/\lambda(\alpha^2-1)^{1/2}], \quad (1)$$

where α=A/R.

Since this model is a uniform transmission line operating in a pure TEM mode, the peak magnetic field is related to the peak electric field by $$B_p(\text{in mT})=(10^9/c)E_p(\text{in MV/m}), \quad (2)$$

The energy content U is related to the transverse gradient $E_t$ by $$U=E_t^2(\epsilon_0/32\pi)\lambda^3\cos h^{-1}(\alpha)\exp[4\pi R/\lambda(\alpha^2-1)^{1/2}], \quad (3)$$

Where $\epsilon_0$ is the permittivity of the vacuum in SI units.

$$G=QR_s=2\pi Z_0R/\lambda[\cos h^{-1}(\alpha)]/[(8R/\lambda)\cos h^{-1}(\alpha)+\alpha/(\alpha^2-1)^{1/2}], \quad (4)$$

Where $Z_0=(\mu_0/\epsilon_0)^{1/2}$; 377Ω is the impedance of the vacuum.

The transverse shunt impedance, defined as $R_t=V_t^2/P$ where P is the power dissipation, is $$R_t/Q=4Z_0\{\exp[-4\pi R/\lambda(\alpha^2-1)^{1/2}]\}/[\cos h^{-1}(\alpha)], \quad (5)$$

Figure 4:
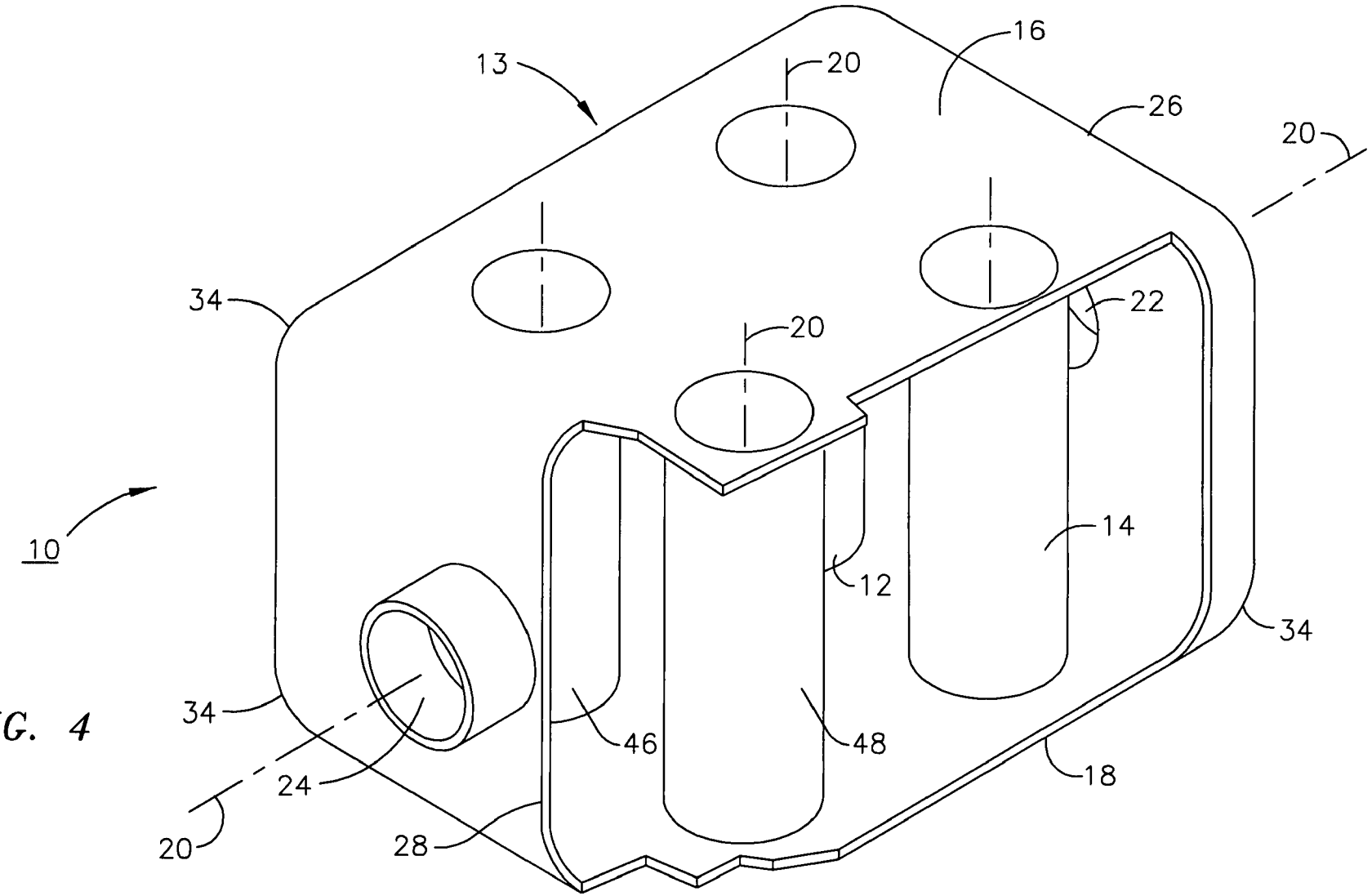
FIG. 4 is a perspective view of a two cell parallel-rod deflecting cavity in accordance with the present invention.
Figure 5:
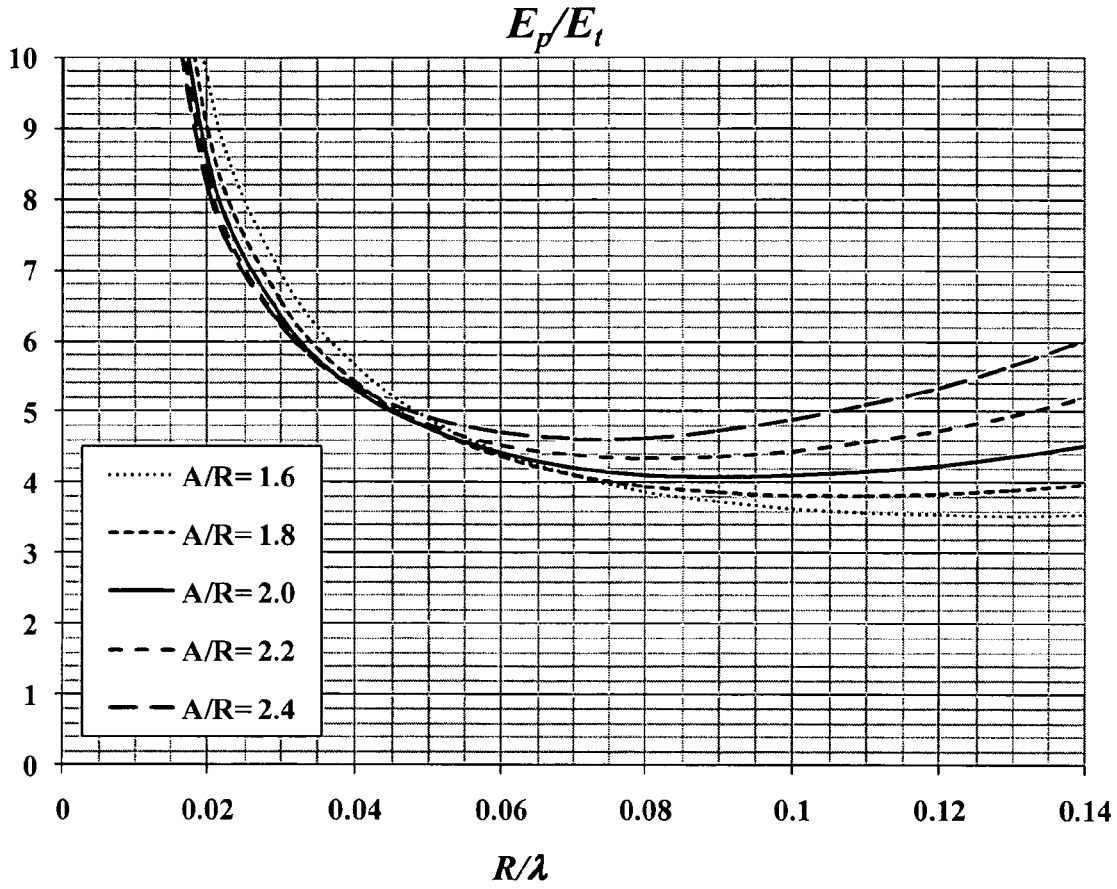
FIG. 5 is a graph showing the ratio of peak to transverse electric field given by equation 1 described below.

It should be noted that the electromagnetic properties can be expressed simply as functions of R/λ and α=A/R. Universal curves for the peak surface electric field and the product of the geometrical factor G and $R_t/Q$ are shown in FIGS. 4 and 5. The peak surface electric (and magnetic) field has a weak dependence on R/λ and A/R but is minimum for a rather large R/λ. $G*R_t/Q$, on the other hand, has a much stronger dependence on both and is maximum for smaller R/λ. Thus the final design will depend on which parameter to optimize, and in particular whether the structure will be normal or superconducting.

Since one of the main characteristics of this geometry is its small transverse size, it would be particularly attractive at low frequency, and preliminary design activities have focused on a 400 MHz single-cell cavity.

Figure 6:
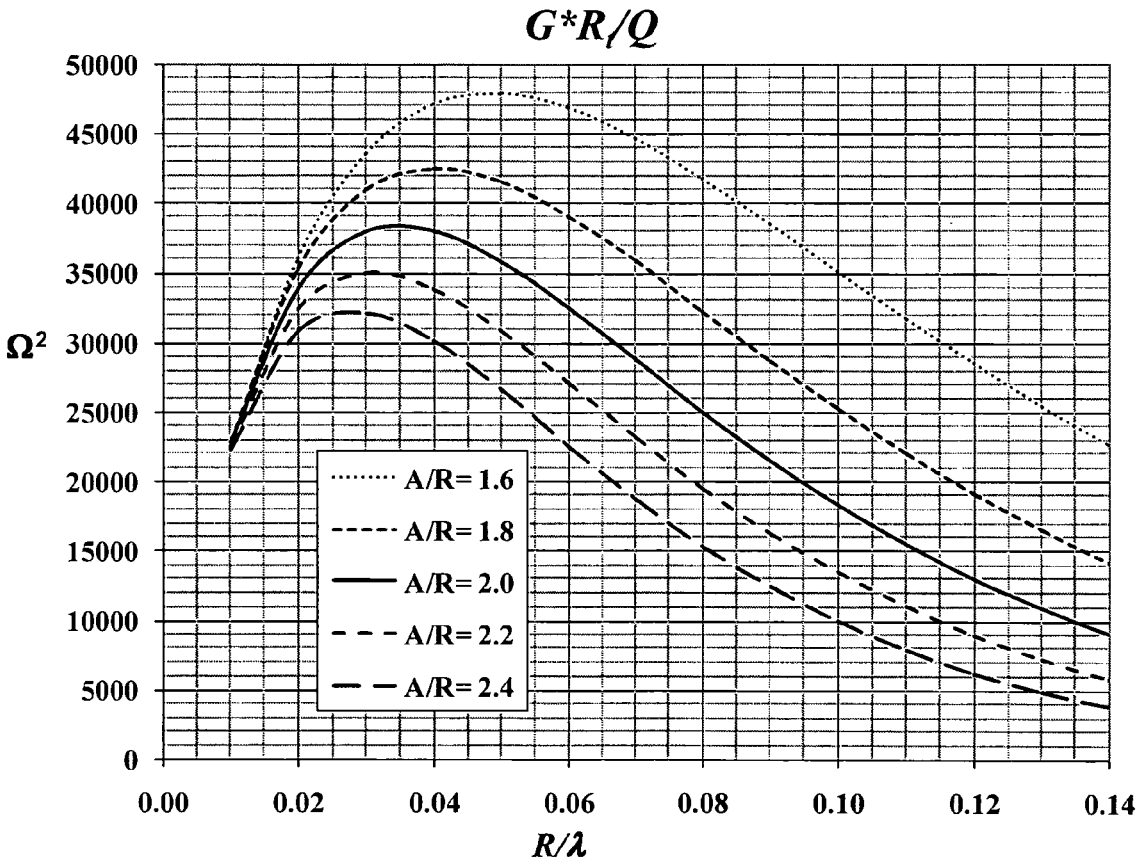
FIG. 6 is a graph showing the geometrical factor G and the transverse shunt impedance R/Q given by equations 4 and 5 described below.
Figure 7:
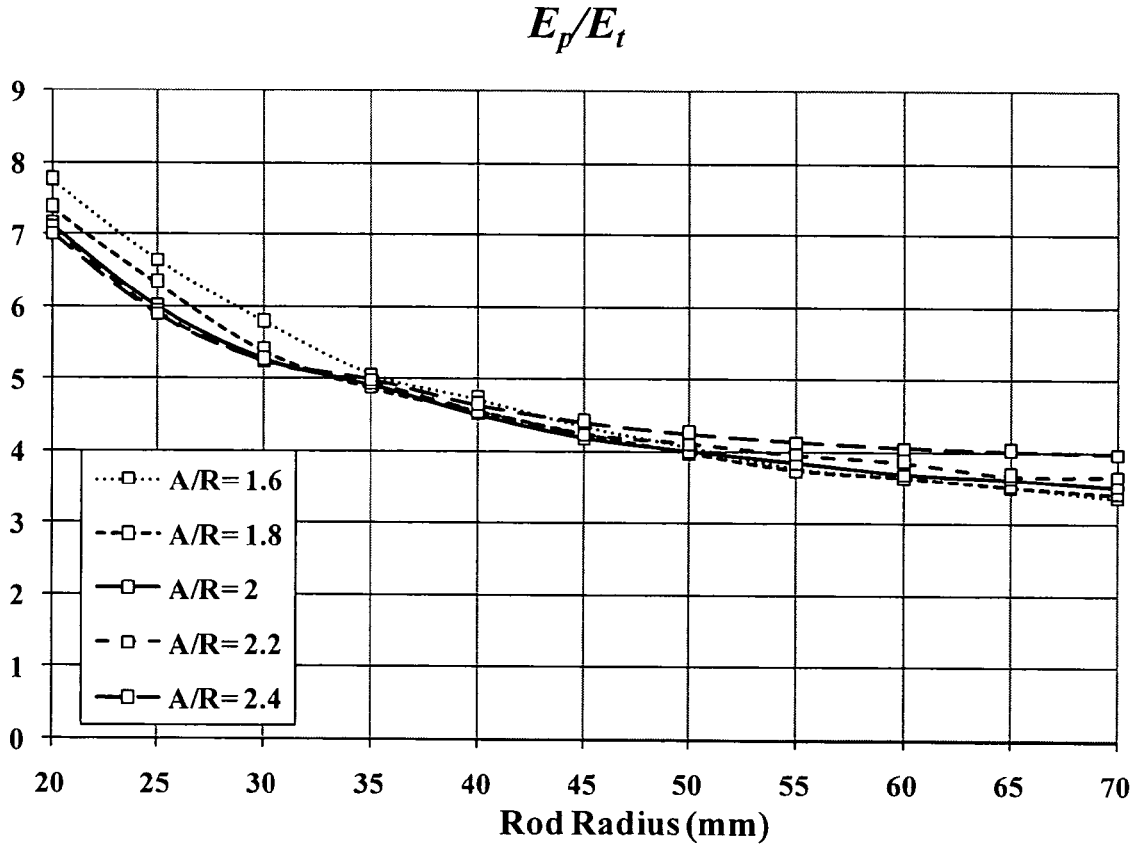
FIG. 7 is a graph showing the ratio of peak to deflecting electric field for the 400 MHz structure shown in FIG. 1.
Figure 8:
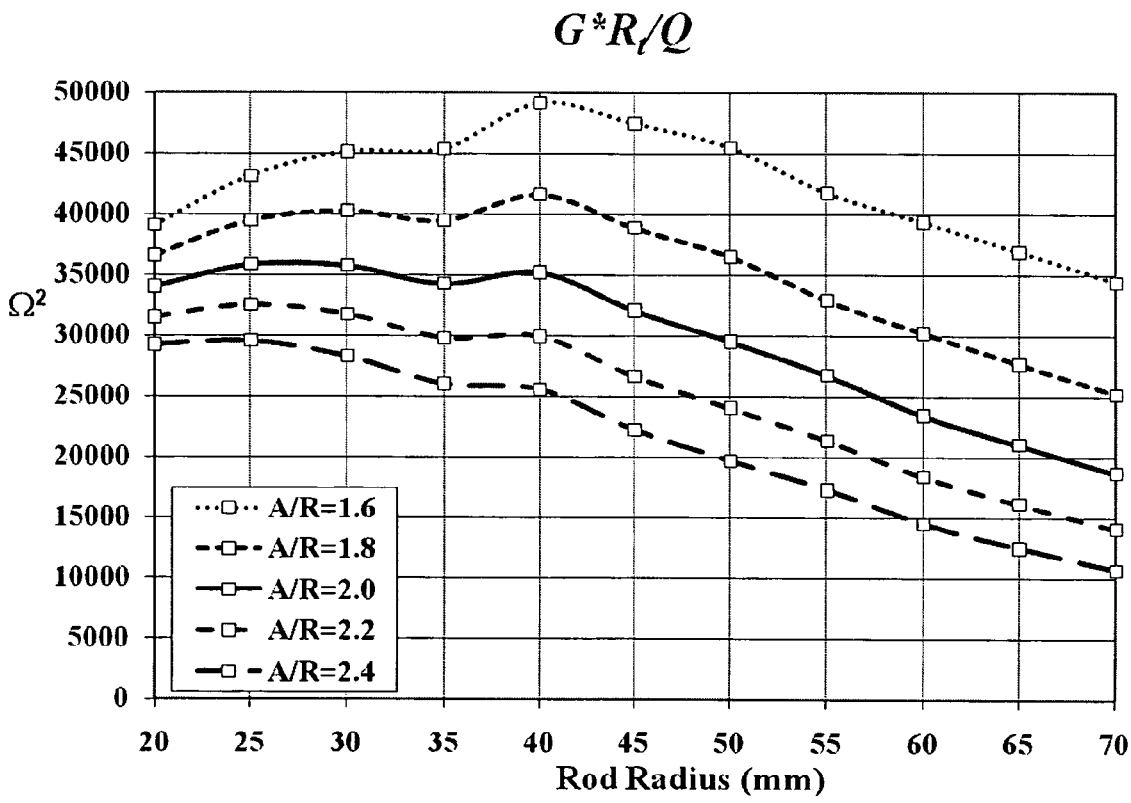
FIG. 8 is a graph showing the ratio of peak to G*R/Q for the 400 MHz structure shown in FIG. 1.

The lengths of rods 12 and 14 and of housing 13 were, to first order, fixed at 375 mm and the main design parameters were the radii and separation of the two parallel bars. Results of simulations using CST Microwave Studio® are shown in FIG. 6. They compare very favorably with the analytical results previously discussed. The transverse shunt impedance of this design is quite high compared to designs based on $TM_{110}$ modes. This is similar to the high shunt impedance of TEM accelerating structures compared to $TM_{010}$ structures.

For velocity-of-light applications TEM accelerating structures have peak surface fields larger that $TM_{010}$ structures. The analytical model and these simulations show that this is not the case for deflecting cavities as peak surface fields for TEM structures are comparable to those in $TM_{110}$ structures.

Properties of a preliminary design of a 400 MHz parallel-rod deflecting structure 10 obtained from Omega3P are shown in Table 1 below. It should be noted that the deflecting π-mode is the lowest frequency mode, which would simplify the damping of all the other modes in high-current applications.

TABLE 1

Properties of parallel-bar structure shown in FIG. 1 calculated from Omega3P and analytical model.

| Parameter | Ω3P | Analytical model | Unit |
|---|---|---|---|
| Frequency of π-mode | 400 | 400 | MHz |
| λ/2 of π-mode | 374.7 | 374.7 | mm |
| Frequency of 0-mode | 414.4 | 400 | MHz |
| Cavity length | 374.7 | ∞ | mm |
| Cavity width | 500 | ∞ | mm |
| Rods length | 381.9 | 374.7 | mm |
| Rods diameter (2R) | 100 | 100 | mm |
| Rods axes separation (2A) | 200 | 200 | mm |
| Aperture diameter | 100 | 0 | mm |
| Deflecting voltage $V_t$* | 0.375 | 0.375 | MV |
| $E_p$* | 4.09 | 4.28 | MV/m |
| $B_p$* | 13.31 | 14.25 | mT |
| U* | 0.215 | 0.209 | J |
| G | 96.0 | 112 | Ω |
| $R_t/Q$ | 260 | 268 | Ω |

*at $E_t$ = 1 MV/m

As will be apparent to the skilled artisan, the single-cell opposing pair rod structure 10 discussed so far can be straightforwardly extended to a multicell structure by the addition of sets of generally parallel rods 46 and 48 separated by λ/2 as shown in FIG. 4. In the deflecting mode of operation each of rods 12 and 14 and 46 and 48 oscillates in opposite phase from its nearest neighbors and each rod oscillates in opposite phase from the opposing rod across beam line 20. This will increase the degree of degeneracy since the number of TEM modes is equal to the number of bars, and splitting the (π,π) deflecting mode from all the others will need to be provided, for example by shaping the outer walls or introducing partial walls between the sets of rods. The addition of multiple additional rod pairs is, of course, possible providing the spatial limitations and requirements discussed herein are met.

Figure 9:
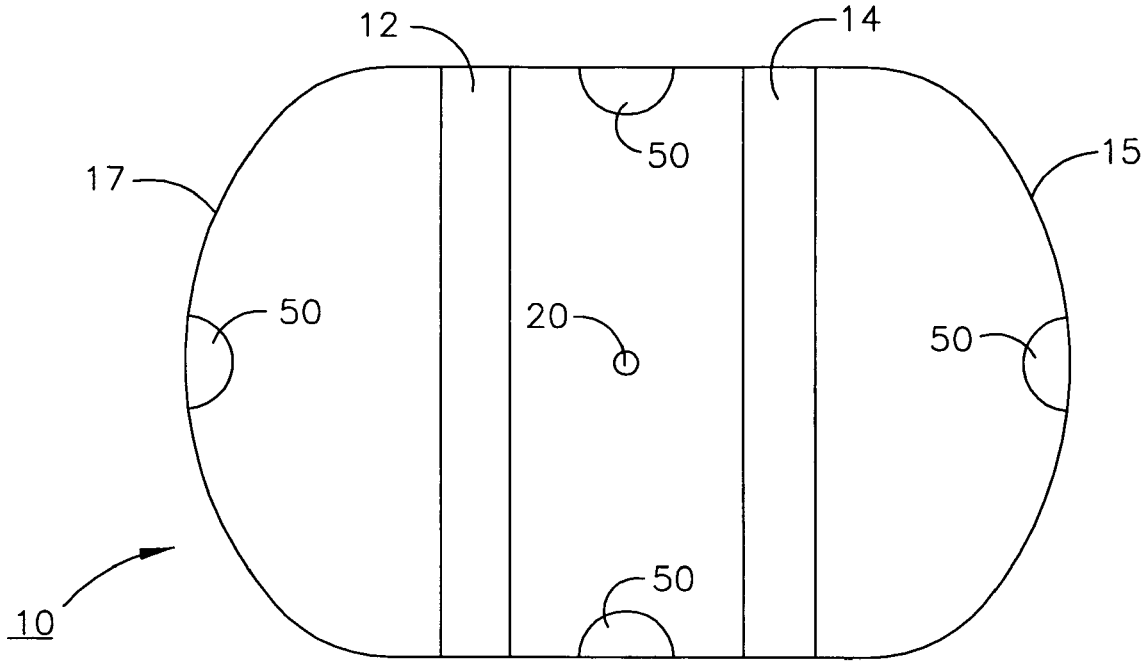
FIG. 9 shows a schematic side view of an alternative embodiment of the structure of the present invention.
Figure 10:
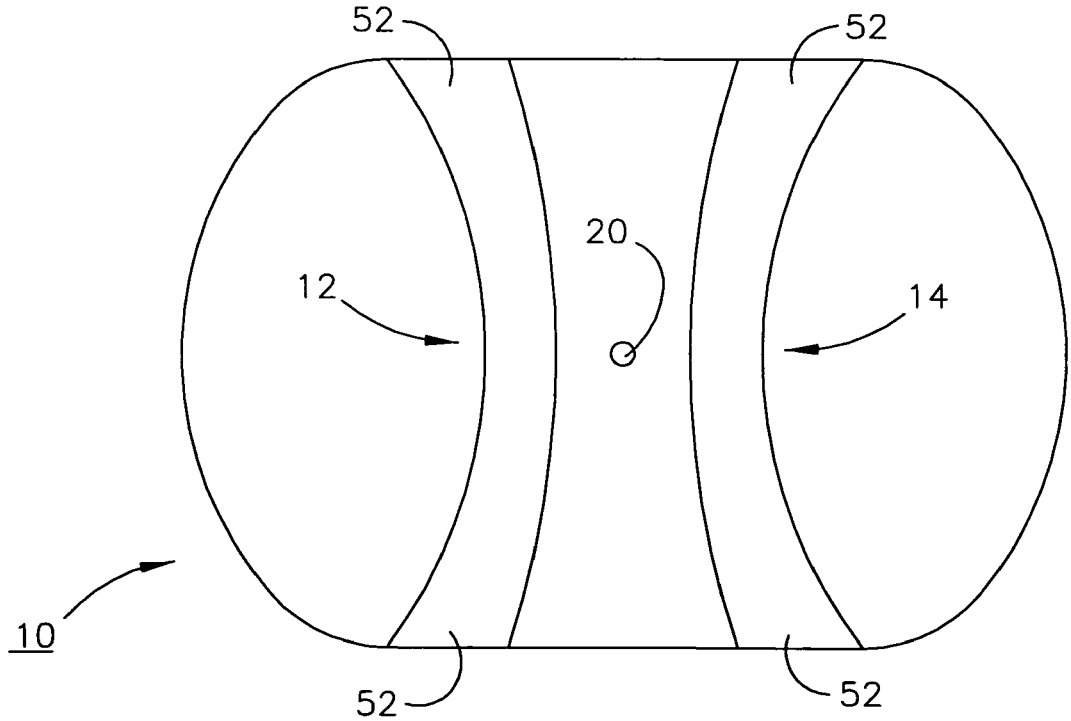
FIG. 10 shows a schematic side view of yet another alternative embodiment of the structure of the present invention.

In order too reduce degeneracy and to optimize, for example rf efficiency, some modifications to the basic design are possible and some possible such modifications are shown in FIGS. 9 and 10. In FIG. 9 the addition of dimples 50 at the mid-plane on side walls 15 and 17 and on end/shorting plates 16 and 18 enhances the splitting between the (π,π) deflecting mode and all others. In FIG. 10 in order to optimize rf efficiency, i.e. reduce peak fields, rods 10 and 12 have flared ends 52 and are curved.

All the above examples use straight circular cylinders for rods 12, 14, 46 and 48. Further optimization can be obtained by deviation from a circular cross-section, deviation from a constant cross-section (hyperboloidal shape) and deviation from a straight rod centerline (see for example FIG. 10). These and other modifications will yield geometries with a lower surface magnetic field, for example, at the expense of added engineering complexity.

As will be apparent to the skilled artisan, for room temperature applications, the material of choice for fabrication of structure 10 as just described is copper while for superconducting operations in liquid helium it would be niobium.

The level of rf energy applied to deflecting/crabbing structure 10 is largely a function of the particular installation. One would like, in general to produce a deflecting voltages of a few MV (million volts). If structure 10 is superconducting, a few 10s of watts of injected rf power will be required. In this case the limit is the breakdown rf field of the superconductor. If structure 10 is normal conducting, it will require several 10's of kW (kilo watts) of injected rf power. In this case the rf power limit is related principally to the ability of the particular installation to cool structure 10 to remove all of the kWs of injected rf energy.

An important characteristic of the design described herein is that it has a high shunt impedance (defined as Rt/Q) above). This is a measure of the amount of rf power needed to be provided by the rf source to generate the deflecting voltage. The higher the shunt impedance, the lower the amount of rf power required. Thus, this design is very efficient compared to other designs.

There has thus been described a novel particle beam deflecting/crabbing structure that is compact, minimizes transverse dimensions and is useful at low operating frequencies.

As the invention has been described, it will be apparent to those skilled in the art that the same may be varied in many ways without departing from the spirit and scope of the invention. Any and all such modifications are intended to be included within the scope of the appended claims.

What is claimed is:

1. A compact particle beam deflecting/crabbing structure comprising:

A) a housing having opposing side walls, top and bottom shorting plates and opposing end walls;

B) at least one pair of opposing generally parallel rods susceptible to injected rf energy extending from the top shorting plate to the bottom shorting plate between the side walls, the opposing generally parallel rods having a length about equal to one half the wavelength of the injected rf energy;

C) and further including beam pipe apertures in the opposing side walls that define a path for a particle beam line passing through the housing and between the pair of opposing generally parallel rods at mid-plane.

2. The compact particle beam deflecting/crabbing structure of claim 1 wherein the side walls, the end walls and the junctions between the top and bottom shorting plates, the side walls or the end walls are curved or rounded.

3. The compact particle beam deflecting/crabbing structure of claim 1 wherein the end walls include dimples at mid-plane.

4. The compact particle beam deflecting/crabbing structure of claim 1 wherein the pair of opposing rods are curved away from each other.

5. The compact particle beam deflecting/crabbing structure of claim 1 wherein the pair of opposing rods have opposing ends that contact the top and bottom shorting plates and the opposing ends are flared.

6. The compact particle beam deflecting/crabbing structure of claim 1 including a plurality of pairs of opposing generally parallel rods, each of the neighboring rods oscillating in opposite phase from it two nearest neighbors.

7. The compact particle beam deflecting/crabbing structure of claim 1 fabricated from a material selected from the group consisting of copper and niobium.

* * * * *